United States Patent [19]

Williams

[11] Patent Number: 5,033,898

[45] Date of Patent: Jul. 23, 1991

[54] TOOTHBRUSH WITH SPONGE FLOW CONTROL

[76] Inventor: Curtis C. Williams, 1551 W. 80th St., Los Angeles, Calif. 90047

[21] Appl. No.: 512,483

[22] Filed: Apr. 23, 1990

[51] Int. Cl.[5] ..... A46B 11/02

[52] U.S. Cl. ..... 401/283; 401/186; 401/280; 401/287

[58] Field of Search ..... 401/183, 184, 186, 268, 401/271, 280, 283, 287

[56] References Cited

U.S. PATENT DOCUMENTS

| | | | |
|---|---|---|---|
| 2,594,721 | 4/1952 | Beebe | 401/186 X |
| 2,932,840 | 4/1960 | Lathrop | 401/183 X |

FOREIGN PATENT DOCUMENTS

| | | | |
|---|---|---|---|
| 266385 | 11/1968 | Austria | 401/268 |
| 2526710 | 12/1976 | Fed. Rep. of Germany | 401/287 |
| 2816557 | 11/1978 | Fed. Rep. of Germany | 401/186 |
| 3033295 | 3/1982 | Fed. Rep. of Germany | 401/287 |
| 2941217 | 4/1982 | Fed. Rep. of Germany | 401/287 |
| 2357204 | 3/1978 | France | 401/271 |
| 2070922 | 9/1981 | United Kingdom | 401/280 |

*Primary Examiner*—Steven A. Bratlie
*Attorney, Agent, or Firm*—Erik M. Arnhem

[57] ABSTRACT

A toothbrush having a self-contained supply of cleaning liquid. Multiple miniature liquid flow openings are formed in the brush holder portion of the toothbrush, such that the cleaning liquid is distributed onto essentially all of the brush clusters. In one form of the invention liquid flow is restricted by porous sponge elements extending across the flow openings. In another form of the invention the multiple flow openings are of pinhole size in order to restrict the liquid flow.

1 Claim, 1 Drawing Sheet

TOOTHBRUSH WITH SPONGE FLOW CONTROL

BACKGROUND AND SUMMARY OF THE INVENTION

This invention relates to a toothbrush having a self-contained supply of teeth cleaning fluid. The handle of the toothbrush is constructed as an elongated flexible walled liquid container. An elongated bristle holder means extends longitudinally from the liquid container. A liquid passage means extends from the container within the bristle holder means to supply liquid to a multiplicity of small flow openings located between spaced clusters of bristles. When a manual squeezing force is exerted on the flexible walled container liquid is forced out of the multiple flow openings into the vacant spaces between the bristle clusters.

It is contemplated that there will be a relatively large number of liquid flow openings in the bristle area, e.g. thirty or more flow openings. Substantially all of the bristle clusters will be subjected to a liquid wetting action, such that the bristles will have an optimum teeth cleaning action.

The broad concept of a toothbrush equipped with a self-contained supply of teeth cleaning fluid is already known. Applicant is aware of the following U.S. patents disclosing the broad concept: U.S. Pat. No. 818,000 to C. Stevenson; U.S. Pat. No. 973,865 to J. Hitz; U.S. Pat. No. 1,610,831 to A. Wallace; U.S. Pat. No. 1,780.066 to T. Christian; U.S. Pat. No. 2,250,758 to C. French; U.S. Pat. No. 2,743,042 to L. Burgin; U.S. Pat. No. 3,903,888 to Buelow et al; and U.S. Pat. No. 4,615,635 to K. Kim.

Most of the patented devices appear to use paste-type cleaning fluids, not liquid cleaning fluids. Most of the patented devices have a single paste discharge opening communicating with the bristles. The present invention contemplates a device having a large multiplicity of flow openings for discharging liquid cleaner material into the bristle space. The liquid can be conventional mouthwash or a special liquid formulation designed for teeth cleaning purposes.

The toothbrush can be used without water, such that persons are enabled to clean their teeth at times and places when/where there is no water available, e.g. in a car or at a campsite.

THE DRAWINGS

DESCRIPTION OF A PREFERRED EMBODIMENT OF THE INVENTION

Figure 1:
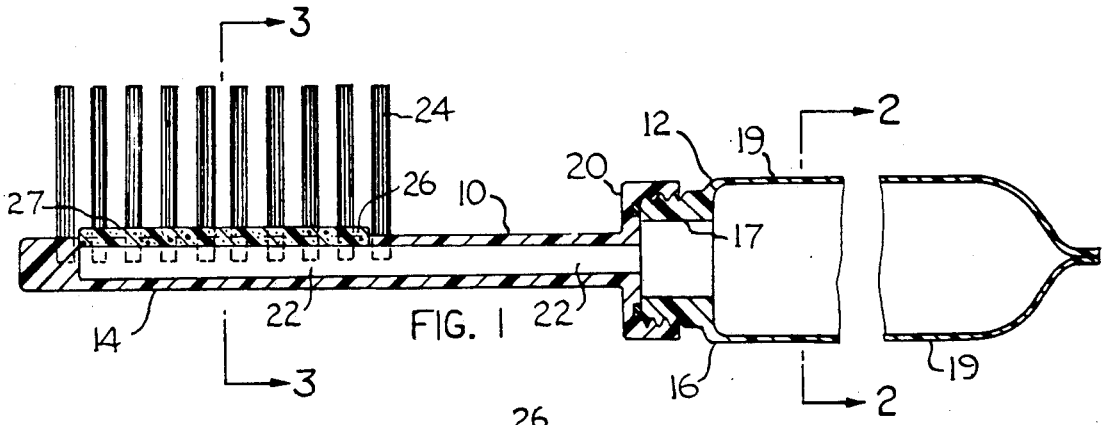
FIG. 1, is a longitudinal sectional view taken through a toothbrush embodying the invention.
Figure 3:
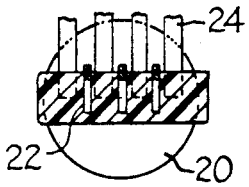
FIG. 3 is a sectional view on line 3—3 in FIG. 1.
Figure 2:
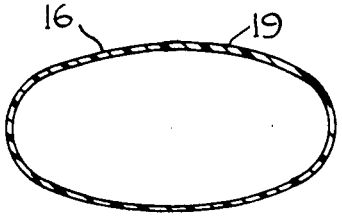
FIG. 2 is a sectional view taken on line 2—2 in FIG. 1.

FIGS. 1 through 3 illustrate a toothbrush 10 that includes a handle structure 12 and a bristle holder means 14. Handle structure 12 comprises an elongated flexible walled liquid container 16 having an externally threaded discharge neck structure 17. Structure 17 is a relatively thick annular wall such that it is rigid (non-flexible). Container wall 19 is relatively thin and flexible; it is formed of a plastic material having a memory, so that when the container is squeezed it will deform inwardly but later return to its initial configuration when the squeezing pressure is removed. Container 16 is a conventional container structure commonly used to store cosmetic lotions, sealants and other liquid or semi-liquid materials. As shown in FIG. 2, the container has an oval cross section, except that the container shoulder area near neck structure 17 is circular.

Bristle holder means 14 includes an internally threaded socket 20 adapted to screw onto neck structure 17 to form a sealed connection at the joint between container 16 and three passages 22 that extend longitudinally through brush holder means 14. Passages 22 comprise three separate hollow channels that extend between the anchored sections of bristles 24. As seen in FIG. 3, there are four rows of bristles (or clusters of bristles). As seen in FIG. 1, there are ten clusters of bristles in each row. Each cluster of bristles may contain twenty five or more individual bristles. Passages 22 extend from socket 20 to a point approximately in line with the endmost bristles 24. Three relatively narrow slot openings 26 extend upwardly from passages 22 into communication with the vacant spaces between the rows of bristle clusters; each slot opening 26 has a length that substantially spans the length dimension of the bristle cluster rows.

Each slot opening 26 is relatively narrow, e.g. only about 0.02 inch across. A porous sponge strip 27 extends within and along each slot opening 26 for restricting liquid flow through the slot opening. The restricting action is such that when the toothbrush is in a normal unstressed condition (no squeezing force on container 16) there is no liquid flow through slot openings 26.

Handle structure 12 is designed to permit the user to firmly grip the outer surface of socket 20 between the thumb and first finger. The fingers will be curled around container wall 19, with the last two fingers engaged against the relatively flat outer surface of wall 19. When the last two fingers are squeezed against the container wall the increased liquid pressure forces liquid through the pores in sponge strips 27. The flow can be increased to a certain extent by increasing the pressure exerted by the user's last two fingers on container wall 19.

The three sponge strips 27 provide a multiplicity of small flow openings spanning the zone occupied by the various bristle clusters. The simultaneous liquid flows through the various flow openings served to wet substantially all of the bristle clusters, thereby promoting an effective and extensive teeth cleaning action.

Figure 4:
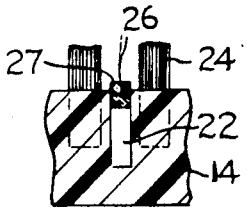
FIG. 4 is a fragmentary enlarged sectional view taken in the same direction as FIG. 3.
Figure 5:
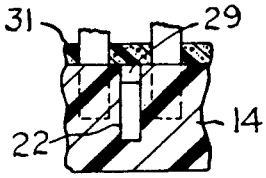
FIG. 5 is a view taken in the same direction as FIG. 4, but illustrating a structural variation that can be employed.

FIG. 5 fragmentarily shows a variant of the FIG. 4 arrangement, wherein each slot opening 26 is replaced by a number of discrete circular flow openings 29. FIG. 5 shows one such flow opening. Additional flow openings are provided in front of, and behind, the plane of the paper in FIG. 5. Typically there will be ten openings 29 in a row; there are three rows of openings arranged in parallel as shown in FIG. 3. A porous sheet 31 is arranged on the face of bristle holder means 14 to overlie the various openings 29. The sponge sheet acts as a flow restrictor means.

Figure 6:
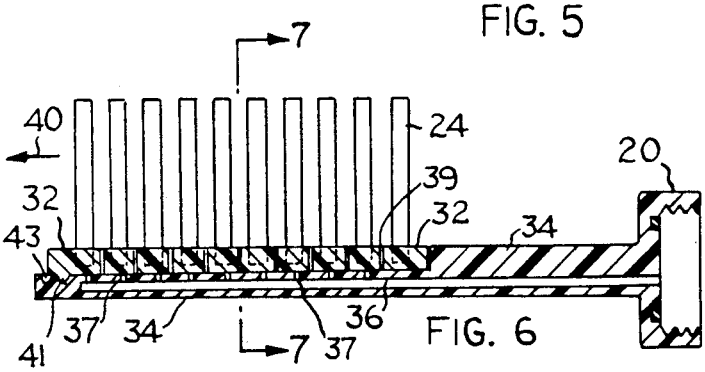
FIG. 6 is a longitudinal sectional view taken through a second embodiment of the invention, along line 6—6 in FIG. 7.
Figure 7:
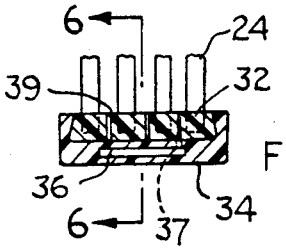
FIG. 7 is a sectional view taken on line 7—7 in FIG. 6.

FIGS. 6 and 7 illustrate another form that the invention can take. In this case bristles 24 are anchored in an auxiliary slide section 32 that is slidably mounted on a main stem section 34 of the brush holder means. A relatively flat rectangular cross-sectioned passage 36 extends longitudinally within main stem section 34 from socket 20 to a point below the endmost bristle cluster. Three rows of flow ports 37 extend upwardly from passage 36 at spaced points therealong.

Slide section 32 has three rows of small flow openings 39 extending downwardly toward passage 36. These flow openings are arranged in rows, with the in-row spacing and spacing between rows being similar to the spacings of flow ports 37. Slide section 32 can be manually moved along the face of main stem section 34 as indicated by arrow 40, such that flow openings 39 are out of liquid communication with ports 37; a detent rib 41 extends from slide section 32 into a recess in the face of stem 34, to releasably retain the slide section in its FIG. 6 position. The slide section can however be manually moved leftwardly such that rib 41 enters into a second recess 43 in stem section 34; when rib 41 snaps into recess 43 the various flow openings 39 are in liquid communication with flow ports 37.

Each flow opening 39 is preferably a circular opening of pin hole size, e.g. about 0.01 inch in diameter. The vertical length of each flow opening 39 is several times the hole diameter. For example, each hole 39 can have a length of about 0.1 inch (ten times the hole diameter). These hole dimensions enable the holes to exert a restrictive action against liquid flow. Even when flow openings 39 are in communication with ports 37 there will be no liquid flow through openings 39 until a manual squeeze force is applied on container wall 19 (FIGS. 1 and 2).

Slide structure 32 will ordinarily be set in its FIG. 6, "closed" position in order to prevent slow weeping of liquid through openings 39 and/or to prevent liquid flow due to inadvertant pressure on the liquid container, and/or to prevent residue formations in the flow ports due to evaporation. Flow ports 37 can be somewhat larger than openings 39 if desired, in order to ensure alignment of all openings and ports when slide structure 32 is in its open position.

Both illustrated forms of the invention provide multiple liquid flows into the various vacant spaces between the bristle clusters, thereby enabling substantially all of the various bristle clusters to be subjected to a liquid wetting action. The drawings necessarily show specific forms of the invention. However, it will be appreciated that the invention can be practiced in other forms.

What is claimed is:

1. A toothbrush comprising an elongated flexible walled liquid container having an externally threaded discharge neck structure at one end thereof, said liquid container forming a handle for the toothbrush; an elongated bristle holder means having an internally threaded socket at one end thereof adapted to screw onto said externally threaded discharge neck structure; bristles extending from said holder means remote from said threaded socket; said bristles being arranged in multiple rows of bristle clusters with vacant spaces between the rows, and with vacant spaces between the clusters in each row; said rows of bristle clusters extending parallel to each other along the longitudinal dimension of the elongated bristle holder means; liquid passage means extending witin said bristle holder means from said internally threaded socket to a point in registry with the bristles; said liquid passage means comprising a plural number of straight slots (22) extending through the bristle holder means wall into communication with the vacant spaces between the rows of bristle clusters; each slot forming an elongated rectangular liquid opening having a length that is substantially the same as the length of each row of bristle clusters; each slot opening being located midway between adjacent rows of bristle clusters, with each slot opening having two rows of bristle clusters extending therealong and a porous sponge strip filling the space within each slot opening so that liquid is required to pass through each sponge in order to reach the vacant spaces between the rows of bristle clusters.

* * * * *